US008256471B2

(12) United States Patent
Selles

(10) Patent No.: US 8,256,471 B2
(45) Date of Patent: Sep. 4, 2012

(54) FUEL STORAGE FACILITY AND METHOD FOR FILLING AND/OR EMPTYING THE TANKS OF SAID FACILITY

(75) Inventor: Serge Albert Pierre Selles, Lyons (FR)

(73) Assignees: IFP, Cedex (FR); Serge Albert Pierre Selles, Lyons (FR)

( * ) Notice: Subject to any disclaimer, the term of this patent is extended or adjusted under 35 U.S.C. 154(b) by 594 days.

(21) Appl. No.: 12/516,022

(22) PCT Filed: Nov. 21, 2007

(86) PCT No.: PCT/FR2007/001918

§ 371 (c)(1),
(2), (4) Date: May 22, 2009

(87) PCT Pub. No.: WO2008/071865

PCT Pub. Date: Jun. 19, 2008

(65) Prior Publication Data

US 2010/0051134 A1 Mar. 4, 2010

(30) Foreign Application Priority Data

Nov. 24, 2006 (FR) ..... 06 10304

(51) Int. Cl.
*B65B 1/04* (2006.01)
*B65B 3/04* (2006.01)

(52) U.S. Cl. ..... 141/2; 141/285; 141/290; 220/89.1; 220/567.2; 220/745

(58) Field of Classification Search ..... 141/2, 290, 141/7, 285; 220/567.2, 745, 89.1
See application file for complete search history.

(56) References Cited

U.S. PATENT DOCUMENTS

| | | | | | |
|---|---|---|---|---|---|
| 4,058,148 | A * | 11/1977 | Potter | 141/198 |
| 4,320,788 | A * | 3/1982 | Lord | 141/290 |
| 4,457,349 | A * | 7/1984 | Vazin | 141/86 |
| 5,289,857 | A | 3/1994 | Pyles | |
| 5,850,849 | A * | 12/1998 | Wood | 137/446 |
| 6,382,240 | B1 * | 5/2002 | MacDonald | 137/312 |
| 7,270,155 | B2 * | 9/2007 | Ho | 141/59 |

FOREIGN PATENT DOCUMENTS

| | | |
|---|---|---|
| EP | 0 598 928 A1 | 11/1992 |
| FR | 2 757 146 | 12/1996 |
| WO | WO 03/006358 A1 | 1/2003 |

* cited by examiner

*Primary Examiner* — Dinh Q Nguyen
(74) *Attorney, Agent, or Firm* — Antonelli, Terry, Stout & Kraus, LLP.

(57) ABSTRACT

This storage facility (I) comprises at least one light fuel tank ($C_1$, $C_2$, $C_3$) and at least one heavy fuel tank ($C_4$), each one of the tanks being equipped with a vent pipe (12, 22, 32, 42). All of the vent pipes open into the same collector (14) intended to communicate these pipes with one another and to be connected to a tank (10) of a delivery vehicle. Furthermore, whether respectively associated with a light fuel tank or a heavy fuel tank, the vent pipes are provided with means (13, 23, 33, 43) for condensing the vent gases flowing through these pipes, the condensates from these condensation means being discharged into the or at least one of the light fuel tanks. It is thus possible to minimize the discharge of light fuel vapors from the facility, whether into the atmosphere or into the tank of the delivery vehicle.

12 Claims, 3 Drawing Sheets

FUEL STORAGE FACILITY AND METHOD FOR FILLING AND/OR EMPTYING THE TANKS OF SAID FACILITY

FIELD OF THE INVENTION

The present invention relates to a fuel storage facility comprising at least one light fuel tank and at least one heavy fuel tank. It also relates to a method for filling and/or emptying the tanks of such a facility.

BACKGROUND OF THE INVENTION

In the sphere of fuel delivery for motor vehicles, the tanks of a storage facility of a service station are conventionally filled with different fuel types. In particular, one distinguishes the fuels referred to as light fuels, such as 98-octane unleaded gasoline, commonly referred to as "98 gasoline", 95-octane unleaded gasoline, commonly referred to as "95 gasoline", the mixture of gasoline and ethanol commonly referred to as "biofuel", or analogous, and the fuels referred to as heavy fuels, such as fuel oil or diesel fuel. The main difference between these two fuel types lies in the markedly higher volatility of the light fuels in relation to the heavy fuels at ambient temperatures, notably between −30° C. and +50° C.

For the light fuels, vapours with high fuel contents are given off from the tanks as they are filled. In order to limit as much as possible atmospheric pollution during filling of the tanks, the vent gases with high fuel vapour contents are not released to nature, but they are generally collected and sent from the light fuel tanks to the tank of the delivery truck. Furthermore, in order to limit the fuel losses undergone by the service station operator, notably in form of fuel vapours made up of volatile organic compounds, document WO-A-03/006, 358 proposes using a condenser on each vent pipe connected to a light fuel tank. These condensers significantly reduce the fuel content of the vent gases sent to the tank of the delivery truck, thanks to cooling of the vent gases from the light fuel tanks. The condensates obtained are redirected to the corresponding tank by gravity.

Although such a facility reduces the losses undergone by the service station operator, the fuel losses are not totally eliminated. The volatile gases recovered in the tank of the delivery truck are expelled only when the truck is subsequently filled with fuel and sometimes the truck driver even carries out illegal degassing to the atmosphere so as to avoid transportation of gases considered to be dangerous.

Besides, upon light fuel distribution from tanks, exterior gas is generally sucked in to compensate for the fuel outflow and to maintain a pressure balance in the tank. The light fuel dispensing nozzles of some service stations are thus equipped with suction ports for sucking the fuel vapours released upon filling of the tank of a motor vehicle and the gases thus sucked are sent out of the light fuel tanks when the driver fills up. A collector connected to all the vent pipes of the light fuel tanks enables, if necessary, to pass the sucked gas from the tank into which it is allowed to the tank from which the fuel is distributed, so as to balance the pressure in all the light fuel tanks. Now, the proportion of sucked gas is generally higher, by about 15%, than the volume of fuel delivered for light fuels. Current facilities are therefore provided, in the vent pipes associated with the light fuel tanks, with safety valves set at +30 mbar and −15 mbar. Volatile organic compounds can thus be discharged to the atmosphere at the level of these valves in case of overpressure.

In existing facilities, there is no suction of the aforementioned type for heavy fuel tanks. Besides, the current regulations require separate collectors (two independent collectors or a collection unit subdivided into two sealed parts by a tight wall) for, respectively, the light fuels and the heavy fuels. Only the collector or the part of the collection unit associated with the light fuels is provided with means for connection to the tank of the delivery truck during filling of the tanks so as to prevent the formation of explosive gas mixtures.

Currently, for a conventional service station with a yearly distribution of typically 17 million litres light fuel, about 2%, i.e. 34,000 litres, are vaporized, i.e. lost for the operator and transported by the delivery truck prior to being degassed, at best, at the refinery when filling the truck again.

The goal of the invention is to overcome these drawbacks and, more particularly, to reduce fuel losses for the operator of a service station without requiring bringing expensive adjustments to existing facilities, while best limiting atmospheric pollution.

SUMMARY OF THE INVENTION

The object of the invention thus is a fuel storage facility comprising at least one tank for a light fuel of 98 gasoline, 95 gasoline or biofuel type, and at least one tank for a heavy fuel of diesel fuel or fuel oil type, each tank being equipped with a vent pipe, the vent pipe(s) of the light fuel tank(s) being provided with condensation means for the vent gases circulating in the pipe(s), the condensates from these condensation means being discharged into the or at least one of the light fuel tanks, characterized in that the vent pipe(s) of the heavy fuel tank(s) is or are provided with condensation means for the vent gases circulating in this or these pipe(s), these condensation means being connected to means for discharging into the or at least one of the light fuel tanks condensates from these condensation means, and in that all of the vent pipes of the light fuel tank(s) and of the heavy fuel tank(s) open into the same collector intended to communicate these vent pipes with one another and to be connected to a tank of a delivery vehicle.

Using condensation means such as a condenser on the vent pipes of the heavy fuel tanks is against usual practice in the sphere considered because one generally considers that heavy products, which are hardly or even not volatile at ambient temperatures, do not need to be condensed. This however involves at least two significant advantages. On the one hand, when the tanks of the facility are refueled by a delivery tank, the vent gases that escape from the light fuel tanks as well as the heavy fuel tanks are efficiently cooled prior to being sent to the delivery tank. The gas sent to the delivery tank to replace the discharged fuels thus has a temperature that is markedly lower than the ambient temperature and greatly limits the formation of vapours or revaporization at the surface of the fuels contained in the tank. On the other hand, when light fuel vapours pass, via the collector common to all the vent pipes, from a light fuel tank to a heavy fuel tank, the condenser associated with this heavy fuel tank condenses these vapours and the condensates obtained are sent from this condenser to at least one of the light fuel tanks. Thus, the fuel particle losses and therefore the financial losses for the operator of the facility according to the invention are limited in relation to those of facilities of the prior art, without requiring significant additional adjustments. In particular, current collectors, wherein a sealed wall tightly separates a circulation subvolume for the vent gases coming from the light fuel tanks and a circulation subvolume for the vent gases coming from the heavy fuel tanks, can be fixed up according to the invention by clearing or by piercing the aforementioned wall so as to communicate the two subvolumes with one another.

According to other characteristics of this facility, considered separately or according to all the technically possible combinations:

the collector is equipped with means for distributing the gases flowing therethrough, sensitive to the pressure of the gases in the various vent pipes, the cooling capacity of the condensation means associated with the heavy fuel tank(s) is markedly lower than that of the condensation means associated with the light fuel tank (s), the or each vent pipe of the heavy fuel tank(s) is provided with a valve arranged between the condensation means associated with this pipe and the collector, and suited to feed ambient air into the heavy fuel tank in case of underpressure in this tank, the collector is provided with a relief valve suited for air venting of the collector in case of overpressure or underpressure in the collector, and the valve associated with the or each vent pipe of the heavy fuel tank(s) is calibrated at a lower pressure than the relief valve, the facility comprises a suction pipe 18 connected between the or at least one of the light fuel tanks and means for collecting the gas released upon light fuel delivery at the level of a dispensing nozzle of a fuel pump meter.

The object of the invention also is a method for filling and/or emptying the fuel tanks of a fuel storage facility, said facility comprising at least one tank for a light fuel of 98 gasoline, 95 gasoline or biofuel type, and at least one tank for a heavy fuel of diesel fuel or fuel oil type, a method wherein the vent gases from the light fuel tank(s) are cooled and the condensates resulting from this cooling are discharged into the or at least one of the light fuel tanks, characterized in that the gases circulating in a or in vent pipe(s) connected between the heavy fuel tank(s) and a collector supplied by the vent gases from the light fuel tank(s) are also cooled, and the condensates resulting from this cooling are discharged into the or at least one of the light fuel tanks.

This method is simple to implement and it guarantees that the major part of the light fuel vapours circulating in the facility is recovered in form of condensates.

According to other characteristics of the method, considered separately or according to all the technically possible combinations:

upon filling of any one of the tanks, the temperature of the gases from the collector, discharged to the outside of the facility, is of the order of −30° C., upon filling and/or emptying of any one of the tanks, the gases circulating in the vent pipe(s) of the heavy fuel tank(s) are permanently cooled, upon filling of the light fuel tank(s), cooling of the vent gases coming from this tank is intensified.

BRIEF DESCRIPTION OF THE FIGURES

Other features and advantages of the invention will be clear from reading the description hereafter, given by way of example, with reference to the accompanying figures wherein.

DETAILED DESCRIPTION

Figure 1:
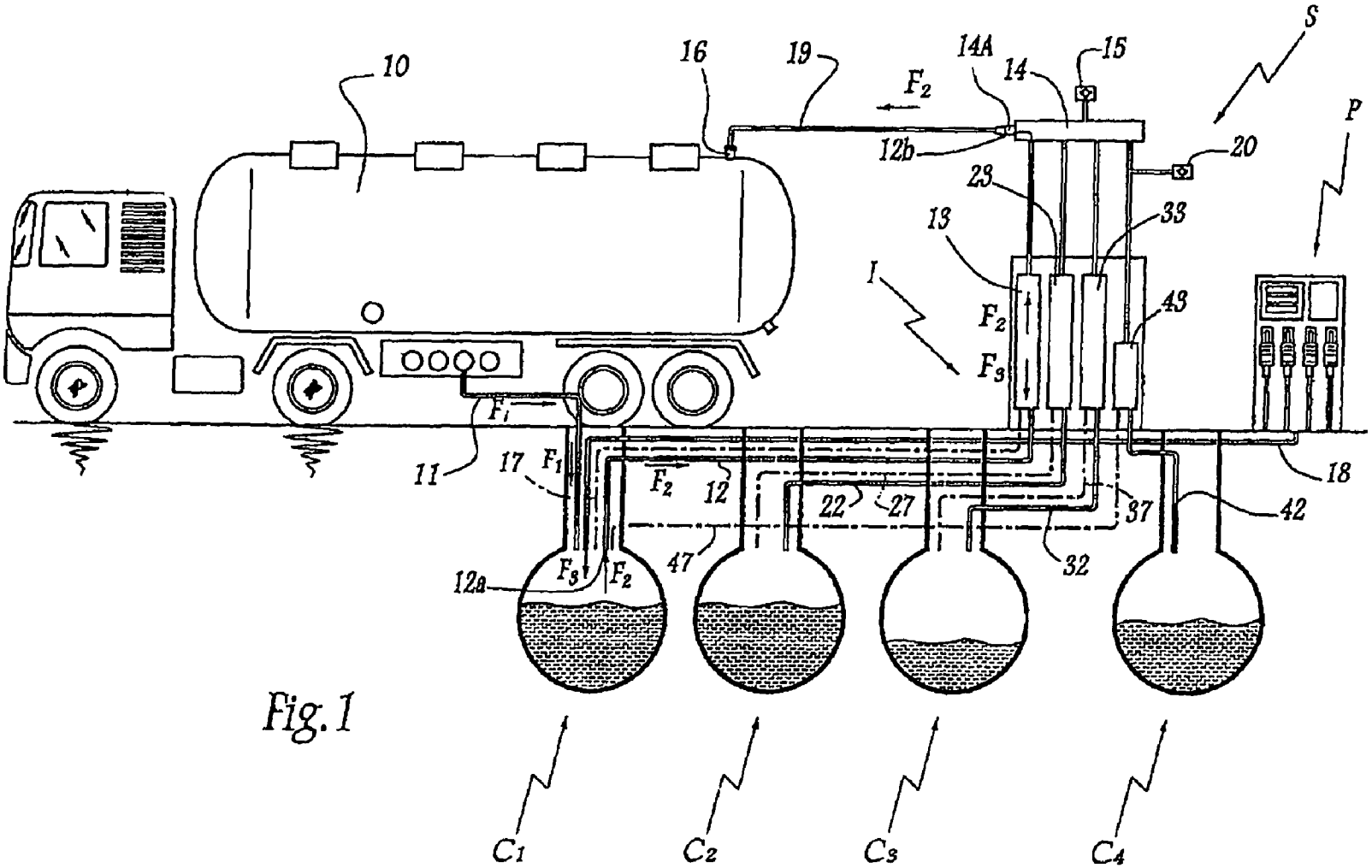
FIG. 1 diagrammatically shows the flowsheet of a service station comprising a facility according to the invention one of the tanks of which is being filled.

FIG. 1 shows a service station S comprising four tanks $C_1$, $C_2$, $C_3$ and $C_4$ of a storage facility I, intended to contain each a fuel designed to be distributed from fuel pump meters or "pumps", only one of which P is shown. Tanks $C_1$, $C_2$ and $C_3$ are intended to contain light fuels, i.e. 98 gasoline, 95 gasoline and biofuel respectively. Tank $C_4$ is intended to contain a heavy fuel, diesel fuel, that is distinguished from the light fuels of tanks $C_1$, $C_2$ and $C_3$ by its lower volatility.

In the configuration shown in FIG. 1, tank $C_1$ is being filled from a tank 10 of a delivery truck, as shown by arrows $F_1$. As it is well known, a transfer pipe 11 connects delivery tank 10 to tank $C_1$ wherein a gauge (not shown) is for example arranged. The inlet orifice 12*a* of a vent pipe 12 is arranged in the upper part of tank $C_1$ to collect the vent gases resulting from the filling operation. The circulation of these vent gases is shown by arrows $F_2$.

Vent pipe 12 is provided, in the intermediate section thereof, with a condenser 13 and it is connected, at the level of its outlet orifice 12*b*, to a collector 14 provided with a relief valve 15 for air venting of the collector in case of gas overpressure or underpressure. Outlet 14*a* of collector 14 is connected by a recycle line 19 to a gas distribution network 16 within tank 10 (more particularly visible in FIG. 3) so that condenser 13 is integrated in a line for collecting the vent gases from tank $C_1$ to the delivery tank, this line being made up of the combination of vent line 12, collector 14, line 19 and network 16.

As explained in detail in document WO-A-03/006,358, the vent gases circulating through pipe 12 are cooled in condenser 13 and are thus freed of their fuel particles that condense and flow towards tank $C_1$ as shown by arrows $F_3$. To reach this tank, the condensates circulate in a specific discharge pipe 17 shown in dot-and-dash line or, in a variant, they flow into vent pipe 12, notably by means of a capillary, either by simple gravity or in forced manner by means of a pump (not shown). In a variant that is not shown, discharge pipe 17 is connected to transfer pipe 11 so as to favour flow of the condensates through Venturi effect caused by the flow of the fuel discharged from tank 10.

Tanks $C_1$, $C_3$ and $C_4$ of facility I are each equipped with a vent pipe 22, 32, 42 opening at the outlet thereof into collector 14 that is therefore common to all of the vent pipes 12, 22, 32 and 42, insofar as the gases can pass from any pipe to another via this collector. Collector 14 is preferably equipped with means for distributing the gases that flow therethrough, sensitive to the gas pressure prevailing in the various vent pipes 12, 22, 32 and 42: if the pressure prevailing in one of these vent pipes is higher than the pressures prevailing in the other pipes, these distribution means balance the gas pressures by allowing part of the gases of the overpressured pipe to flow into the underpressured pipes.

As it is well known, the vent pipes 22 and 32 associated with light fuel tanks $C_2$ and $C_3$ are each equipped with a condenser 23 and 33 substantially similar to condenser 13. Each condenser 23 and 33 is connected to a condensate discharge pipe 27 and 37 similar to pipe 17 associated with condenser 13 and suited to send the condensed vapours at the outlet of each condenser to tanks $C_2$ and $C_3$ respectively.

Unlike known facilities, vent pipe 42 associated with diesel fuel tank $C_4$ is also equipped with a condenser 43. This condenser 43 is arranged in a similar way to condenser 13 of pipe 12, but it is distinguished therefrom by its dimensions. More precisely, the cooling capacity of condenser 43 is markedly lower than that of condensers 13, 23 and 33.

Like the other condensers 13, 23 and 33, condenser 43 is connected to a condensate discharge pipe 47 which, unlike pipes 17, 27 and 37, does not send the condensates to tank C4 from which the vent gases treated in the condenser come, but to one of the light fuel tanks, i.e. for example tank $C_1$ in FIG. 1.

Vent pipe 42 of diesel fuel tank $C_4$ is provided with a valve 20 arranged between condenser 43 and collector 14. This valve is preferably set at a lower pressure than relief valve 15, for example at −5 mbar instead of −15 mbar, so as to allow ambient air to be fed into tank $C_4$ as soon as an underpressure occurs therein, notably upon the distribution of fuel from tank $C_4$ to pump P.

Although not shown in detail, condensers 13, 23, 33 and 43 are for example suited to be supplied with a heat-carrying fluid from a cooling unit intended to cool this fluid, the latter being selected according to the environmental standards in force. This unit comprises for example one or more compressors designed to cool the fluid supplying the condensers to a temperature ranging between −55° C. and −25° C., preferably between about −45° C. and −40° C. Details about the embodiment of condensers of this type are for example given in document WO-A-03/006,358.

Facility I also comprises a suction pipe 18 opening, at one end thereof, into tank $C_1$ and at the opposite end into a gas collection network of fuel pump meter P. In a preferred embodiment, the fuel meter is equipped with fuel dispensing nozzles respectively provided, for light fuel dispensing nozzles, with a suction port for sucking the fuel vapours released upon filling of the tank of a motor vehicle. These suction ports collect the vent gases resulting from the tank filling operation and send them into pipe 18 so that these vapours are notably not released into the atmosphere, but sent back to tank $C_1$. Pipe 18 and the collection network of fuel pump meter P thus make up means for recovering the gases released upon filling of these tanks that meet some environmental standards.

The operation of facility I is now described in connection with FIGS. 2 and 3.

Figure 2:
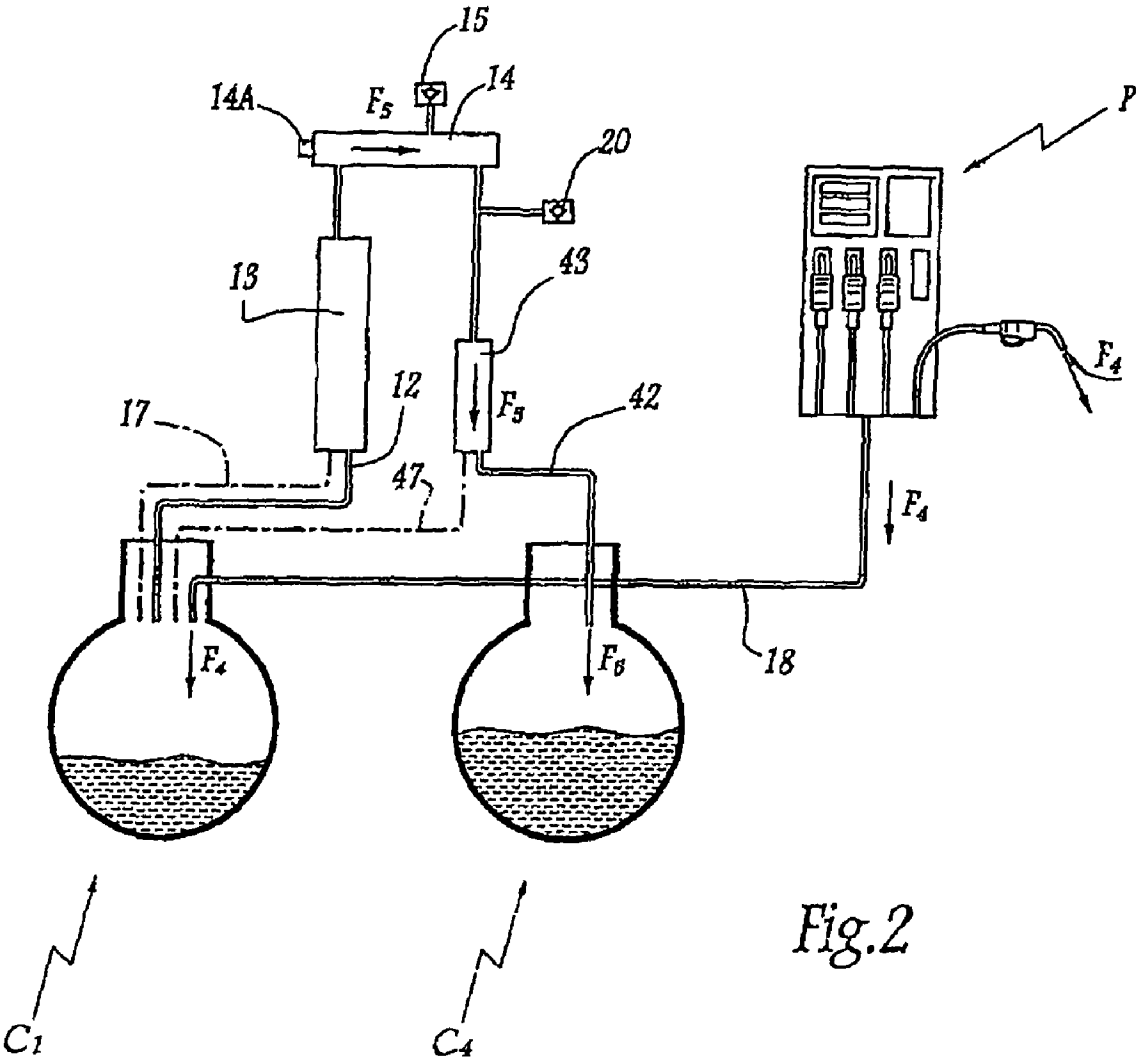
FIG. 2 is a view similar to FIG. 1 showing part of the facility of FIG. 1 whose tanks are being emptied.

In a first case corresponding to a fuel delivery by emptying the tanks of facility I, we consider that, as shown in FIG. 2, by means of fuel pump meter P, a driver takes 98 gasoline from tank $C_1$ in order to fill the tank of his vehicle. During filling of the tank, the dispensing nozzle delivers the 98 gasoline and simultaneously sucks the gas phase present in this tank, notably in order to limit gas discharges damaging to the environment. The sucked gases, shown by arrows $F_4$, are sent via suction pipe 18 into tank $C_1$, in practice, the volume of sucked gas is at least 15% higher than the volume of fuel delivered, which causes an increase in the gas pressure inside this tank. In the same way, one considers that another driver takes diesel fuel from tank $C_4$ by means of another fuel pump meter (not shown) and emptying of tank $C_4$ causes a decrease in the gas pressure inside this tank. In practice, in a country like France, the distribution of diesel fuel generally represents more than half the total fuel distribution for service station S. By means of collector 14, part of the gases contained in tank $C_1$ is then sent via vent pipe 42 into tank $C_4$ so that the pressure prevailing in these tanks is substantially equal. A gas stream laden with light fuel vapours thus flows, as shown by arrow $F_5$, through condenser 43 associated with tank $C_4$, which causes condensation of at least part of these vapours, the condensates being sent via pipe 47 to tank $C_1$. The remaining cooled gases, freed of the major part of their light fuel particles, are sent to tank $C_4$.

Thus, more generally, the light fuel vapours that pass via common collector 14 from one of the tanks $C_1$, $C_2$ and/or $C_3$ to tank $C_4$ are at least partly recovered, by means of condenser 43, in form of condensates discharged to tank $C_1$, it being understood that these condensates could also be discharged to any light fuel tank of the facility. This fuel vapours transfer is all the more marked since the diesel fuel tank is frequently used in relation to the light fuel tanks.

Besides, sending the condensates into one of the light fuel tanks, i.e. tank $C_1$ in the example considered in the figures, and concomitantly sending cooled gases freed of the major part of their light fuel particles into tank $C_4$, and, if need be, into tanks $C_1$, $C_2$ and $C_3$, allows to avoid sending light fuels into heavy fuel tank $C_4$ and to cool the gaseous atmosphere inside the tanks, which limits fuel evaporation in the tanks.

Figure 3:
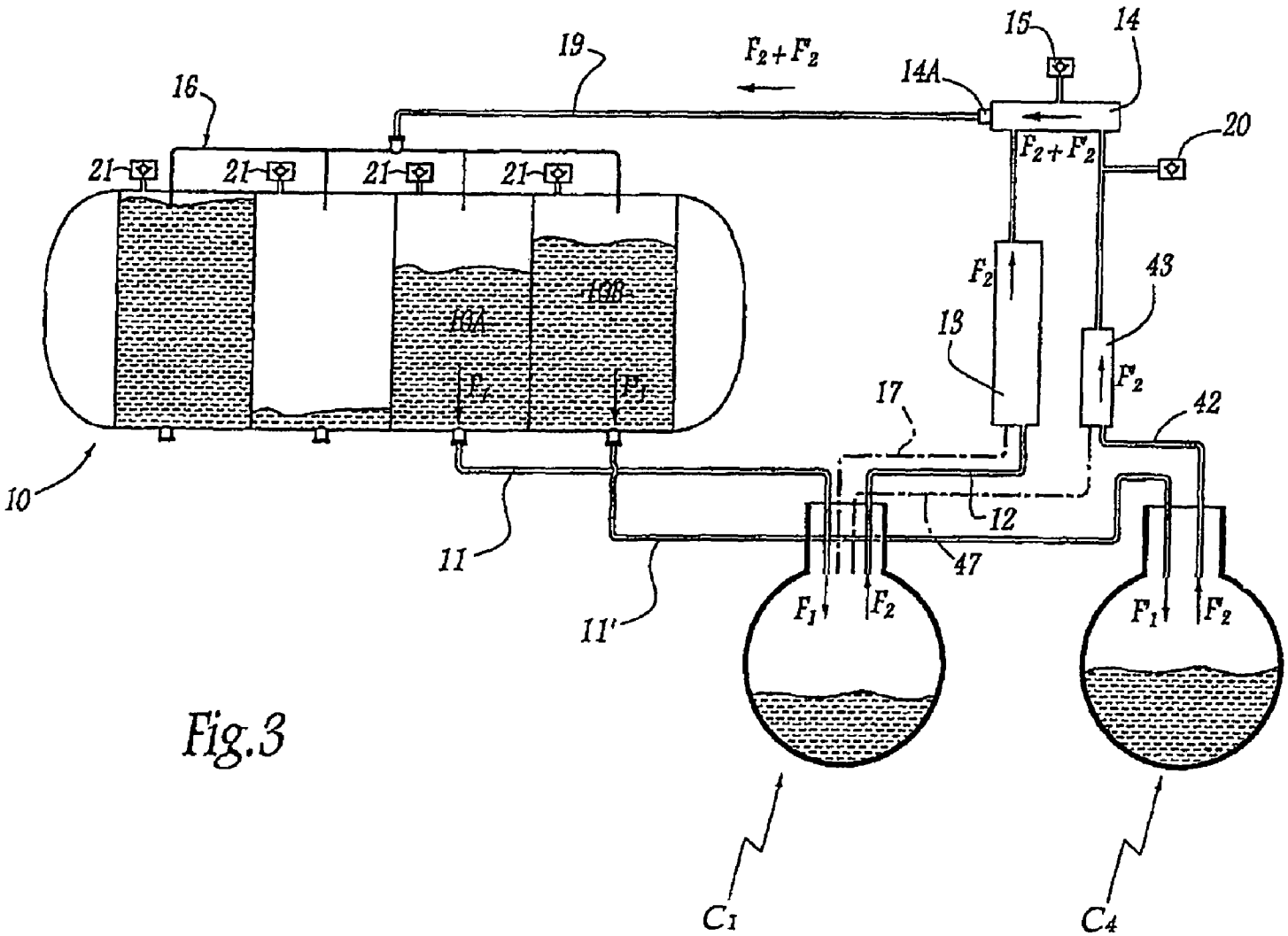
FIG. 3 is a view similar to FIG. 1 showing another part of the facility of FIG. 1 whose tanks are being filled.

In a second case corresponding to the filling of the tanks of facility I, one considers, as shown in FIG. 3, that delivery tank 10 is being emptied so as to supply substantially simultaneously both 98 gasoline tank $C_1$ and diesel fuel tank $C_4$, as shown by arrows $F_1$ and $F_{1'}$ respectively. Transfer pipe 11 therefore connects a compartment 10A of delivery tank 10 to tank $C_1$ and a transfer pipe 11' similar to pipe 11 connects a compartment 10B of the delivery tank to tank $C_4$, distinct from compartment 10A.

Transferring the fuel contained in compartment 10A causes, in tank $C_1$, a gas return phenomenon, i.e. an increase in the fuel volatilization. Furthermore, the fuel flowing into tank $C_1$ expels the gases initially contained in the tank. These two phenomena generate a vent gas stream coming from tank $C_1$ in pipe 12. These vent gases flow through condenser 13 until they reach collector 14, as shown by arrow $F_2$. Condenser 13 causes condensation of the fuel vapours and the condensates obtained flow back, via pipe 17, into tank $C_1$. At the outlet of condenser 13, the temperature of the vent gases freed of the fuel particles is markedly lower than at the inlet, ranging between about −40° C. and −30° C.

Transferring the fuel contained in compartment 10B causes no gas evaporation phenomenon in tank $C_4$ because diesel fuel is a non-volatile fuel at ambient temperature. However, the inflow of diesel fuel causes the expulsion of the gases initially contained in tank $C_4$, these vent gases flowing out through pipe 42 and through condenser 43, as shown by arrows $F'_2$. Although no gas evaporation phenomenon occurs, the gaseous atmosphere initially contained in tank $C_4$ generally comprises a small proportion of light fuel vapours, such as gasoline vapours. In fact, as explained above, when diesel fuel is taken from tank $C_4$, gas coming from outside can be fed into tank $C_1$ via suction pipe 18 and gas streams occur in facility I so that the gas pressure prevailing in each one of tanks $C_1$ to $C_4$ is substantially equal by means of collector 14, leading to gas exchanges between the tanks.

The gases expelled from tank $C_4$ as it is filled are cooled by condenser 43 and a large part of the light fuel vapours contained in these gases is condensed, the condensates obtained being discharged to tank $C_1$ by means of pipe 47. Insofar as part of the fuel vapours has been condensed upon inflow of these vapours into tank $C_4$, as explained in connection with FIG. 2, and since the remaining vapours are diluted in the essentially non-condensable (because essentially made up of air) gaseous atmosphere of tank $C_4$, the gases expelled from tank $C_4$ have a lower light fuel vapour content than the vent gases from tanks $C_1$ to $C_3$. It is thus clear that the cooling capacities of condenser 43 need not be as high as those of condensers 13, 23 and 33. In practice, the compressor(s) intended to cool the heat-carrying fluid circulating in condenser 43 have smaller dimensions than the compressors associated with each condenser 13, 23, 33. In a variant, a single stage compressor can be used.

At the outlet of condenser 43, the temperature of the vent gases reaches a level that is comparable to that of the gases from condensers 13, 23 and 33, i.e. ranging between −40° C. and −30° C. approximately. The gases at the outlet of collector 14, which are sent to delivery tank 10, thus have a temperature of the order of −30° C. These gases then supply, via recycle line 19, gas distribution network 16 in tank 10, so as to replace the volume freed by the fuel transferred. More precisely, network 16 equally distributes the recycled gases in compartments 10A and 10B depending on the respective needs of these compartments, linked with the rate of flow of the fuels transferred. The gaseous atmosphere present in each compartment thus has a cold temperature, lower than the ambient temperature, thus limiting revaporization of the fuels, notably the light ones, at the surface of the liquids being transferred. The continuous inflow of cold recycled gases thus permanently feeds a gas cushion of relatively low temperature that stagnates at the surface of the transferred liquids. The possible losses linked with revaporizations within delivery tank 10 are thus greatly limited.

Facility I according to the invention thus allows to recover, during filling as well as emptying of the tanks, light fuel vapours that were until then lost by the facilities of the prior art. By way of example, about 95% to 98% of the volatile organic compounds can thus be recondensed in facility I, limiting to the minimum volatile organic compound losses for the operator of service station S and increasing the profitability of this service station.

Furthermore, the vapours recycled to tank 10 of the delivery truck are essentially made up of very cold air (at −25° C. for example) and practically free of volatile organic compounds (less than 5% volatile compounds), which makes the delivery truck safer and less polluting. In particular, relief valves 21 respectively provided in the compartments of tank 10 are actuated only in case of a real dysfunction of network 16, and not for regular degassing of these compartments when they are emptied.

Besides, balancing the pressure in all the tanks, by means of collector 14, limits both underpressures in heavy fuel tank $C_4$ and overpressures in light fuel tanks $C_1$, $C_2$ and $C_3$, which saves actuating relief valve 15 and valve 20, except in case of a real dysfunction of the facility. In the facilities according to the prior art, overpressures in the light fuel tanks generally tend to generate significant stresses on the mechanical gauges arranged in these tanks, which may even lift or disengage these gauges. Fuel vapours then infiltrate and stagnate in the part of the gauges accessible from the outside of the tanks, thus involving explosion risks while controlling the gauges.

Advantageously, condenser 43 associated with diesel fuel tank $C_4$ runs continuously during filling and emptying of any one of tanks $C_1$ to $C_4$, so as to limit as much as possible light fuel vapour losses. On the other hand, condensers 13, 23 and 33 associated with tanks $C_1$ to $C_3$ are generally used intensively only upon respective filling of these tanks. Apart from these filling periods, the cooling intensity provided by these condensers is reduced, while preferably maintaining the heat-carrying fluid circulating in these condensers at a lower temperature than the atmospheric temperature so as to allow these condensers to be both quickly operational during gas transfer and sufficiently efficient for treating at least partly the vent gases resulting from the collection of fuel vapours sucked in the vicinity of the dispensing nozzles of pump P. Defrosting of these condensers is also differentiated: condenser 43 is preferably defrosted once a day, during a low-activity period of service station S, notably at night, whereas condensers 13, 23, 33 are preferably defrosted just before and just after filling tanks $C_1$, $C_2$ and $C_3$. In practice, these defrosting operations can be carried out by refrigeration cycle inversion.

Other methods of operation can be considered for condensers 13, 23 and 33. In particular, upon filling one of the tanks $C_1$, $C_2$ and $C_3$, the vent gases from the tank that is being filled may not be permanently sent to the corresponding condenser and can be successively sent instead to the three condensers 13, 23 and 33. The inflow of the vent gases into the three condensers is therefore controlled by a set of valves that are cyclically actuated. Frost thus successively settles in the three condensers without exclusively accumulating in a single one of these condensers, thus limiting the drop in the overall condensation performances linked with the progressive frosting of the condensers.

Various adjustments and variants of the facility and of the method described can be considered. By way of example:

means for measuring the temperature of the gas at the outlet of each condenser 13, 23, 33 and 43 can be provided so as to precisely control the cooling intensity provided by each condenser, in order to optimize their energy expenditures, instead of sending the condensates of each light fuel to the tank containing the corresponding light fuel, notably by means of the corresponding discharge pipes 17, 27 and 37, the condensates coming from the various condensers concerned 13, 23 and 33, and the condensates coming from condenser 43 can be grouped together at the outlet of the condensers in a common discharge pipe opening downstream only into one of tanks $C_1$, $C_2$ and $C_3$, preferably in the tank containing the least expensive light fuel for financial tax reasons, and/or condensers 13, 23 and 33 can be grouped together within a single condensation unit treating the vent gases coming indiscriminately from tanks $C_1$, $C_2$ and $C_3$; similarly, if several heavy fuel tanks are provided in the facility, the vent gases coming from these tanks can be grouped together prior to being subjected to dedicated condensation means distinct from the condensation means associated with the vent pipes of the light fuel tanks.

The invention claimed is:

1. A fuel storage facility comprising at least one light fuel tank and at least one heavy fuel tank, each tank being equipped with a vent pipe, the vent pipe of the at least one light fuel tank being provided with a light fuel condensation means for vent gases circulating in the vent pipe of the at least one light fuel tank, condensates from the light fuel condensation means being discharged into the at least one light fuel tank, wherein the vent pipe of the at least one heavy fuel tank is provided with a heavy fuel condensation means for vent gases circulating in the vent pipe of the at least one heavy fuel tank, the heavy fuel condensation means being connected to a means for discharging condensates from the heavy fuel condensation means into the at least one light fuel tank, and in that all of the vent pipes of the at least one light fuel tank and the at least one heavy fuel tank open into a collector configured to allow the vent pipes to communicate with one another, and the collector configured to be connected to a tank of a delivery vehicle.

2. A facility as claimed in claim 1, wherein the collector is equipped with a means for distributing the gases flowing through the collector, and the means for distributing the gases flowing through the collector being sensitive to the pressure of the gases in the various vent pipes.

3. A facility as claimed in claim 1, wherein a cooling capacity of the heavy fuel condensation means associated with the at least one heavy fuel tank is markedly lower than a cooling capacity of the light fuel condensation means associated with the at least one light fuel tank.

4. A facility as claimed in claim 1, wherein the vent pipe of the at least one heavy fuel tank is provided with a valve arranged between the heavy fuel condensation means associated with the vent pipe of the at least one heavy fuel tank and the collector, and the valve being suited to feed ambient air into the at least one heavy fuel tank in case of underpressure in the at least one heavy fuel tank.

5. A facility as clamed in claim 4, wherein the collector is provided with a relief valve suited for air venting of the collector in case of overpressure or underpressure in the collector, and in that the valve associated with the vent pipe of the at least one heavy fuel tank is calibrated at a lower pressure than the relief valve.

6. A facility as claimed in claim 1, further comprising a suction pipe connected between the least one light fuel tank and a means for collecting a gas released upon light fuel delivery at a level of a dispensing nozzle of a fuel pump meter.

7. A method for filling and/or emptying the tanks of a fuel storage facility, said facility comprising at least one light fuel tank and at least one heavy fuel tank, the method comprising cooling vent gases from the at least one light fuel tank, discharging condensates resulting from the cooling of the vent gases from the at least one light fuel tank into the at least one light fuel tank, cooling gases circulating in a vent pipe connected between the at least one heavy fuel tank and a collector supplied by the vent gases from the at least one light fuel tank, and discharging condensates resulting from the cooling of the gases circulating in the vent pipe connected between the at least one heavy fuel tank and the collector into the at least one light fuel tank.

8. A method as claimed in claim 7, wherein upon filling of any one of tanks, the temperature of the gases from the collector, discharged to the outside of the facility, is of the order of −30° C.

9. A method as claimed in claim 7, wherein upon filling and/or emptying of any one of the tanks, the gases circulating in the vent pipe of the at least one heavy fuel tank are permanently cooled.

10. A method as claimed in claim 7, wherein upon filling of the at least one light fuel tank, cooling of the vent gases coming from the at least one light fuel tank is intensified.

11. A facility as claimed in claim 1, wherein the at least one light fuel tank is configured to contain a fuel selected from the group consisting of 98 gasoline, 95 gasoline, and biofuel; and the at least one heavy fuel tank is configured to contain a fuel selected from the group consisting of diesel and fuel oil.

12. A method as claimed in claim 7, wherein the at least one light fuel tank is configured to contain a fuel selected from the group consisting of 98 gasoline, 95 gasoline, and biofuel; and the at least one heavy fuel tank is configured to contain a fuel selected from the group consisting of diesel and fuel oil.

* * * * *